US005622441A

United States Patent [19]

Lambert, Sr.

[11] Patent Number: 5,622,441

[45] Date of Patent: Apr. 22, 1997

[54] WRITING INSTRUMENT HOUSING

[76] Inventor: Raymond E. Lambert, Sr., 7 Heron La., P.O. Box 334, Cataumet, Mass. 02534

[21] Appl. No.: 492,246

[22] Filed: Jun. 19, 1995

[51] Int. Cl.[6] ..... B43K 7/00; B43K 7/12

[52] U.S. Cl. ..... 401/209; 401/99; 401/109; 401/194; 40/334

[58] Field of Search ..... 401/99, 109, 110, 401/111, 194, 209; 40/334

[56] References Cited

U.S. PATENT DOCUMENTS 3,531,885 10/1970 Dablo ..... 40/335

FOREIGN PATENT DOCUMENTS 789718 1/1958 United Kingdom ..... 40/334
849460 9/1960 United Kingdom ..... 401/110
961246 6/1964 United Kingdom ..... 401/110

*Primary Examiner*—Steven A. Bratlie
*Attorney, Agent, or Firm*—John A. Haug

[57] ABSTRACT

A high quality writing instrument (100) has a special tip member (108) in one embodiment adapted to protect the distal end of the outer shell (102) from damage while allowing the shell to extend essentially all the way to the writing tip end of the instrument. An intermediate bushing 116 removably locks the tip member and threadingly is received in the retraction/protraction mechanism (14). In a second embodiment (130) the outer shell (132) is formed with a thicker wall portion adjacent the writing tip end so that a thread (136) can be formed in the bore. A bushing (140) has an end which is threaded into the bore of the shell with the distal ends of the shell (130) and the bushing (140) being flush and with the bushing (140) protecting the writing tip end from damage. The outer shell (102, 132) of both embodiments can be pierced in a selected pattern showing the outer surface of an inner shell (122, 150) spaced therefrom. In another embodiment a rigid clip member (166) is biased against the body of a writing instrument (160) by means of a force exerted by a discrete spring element (194) received in a cavity (192) of a bushing (176). The clip member (166) has a laterally extending end (172) against which the spring element (194) applies the force.

6 Claims, 3 Drawing Sheets

WRITING INSTRUMENT HOUSING

FIELD OF THE INVENTION

This invention relates generally to writing instruments and more particularly to housings for such instruments.

BACKGROUND OF THE INVENTION

FIG. 1 shows the writing tip portion of a conventional ball point pen with the actual ball point and ink chamber 10 shown in outline and showing a distal end 12 of the retraction/protraction mechanism 14. The outer barrel or shell 16 has a distal end 18 received on a reduced diameter portion 20 of a conventional tip 22. In the more expensive types of pens, the outer shell 16 is generally formed of a relatively high priced metal, such as silver or gold, or a silver or gold plated metal, to provide an aesthetically pleasing writing instrument and tip 22 serves to protect the distal end portion 18 of the shell from damage. Typically, mechanism 14 is formed with an internal or female thread 24 which mates with external or male thread 26 provided on the reduced diameter portion 20 and tip 22 is threaded into mechanism 14 thereby locking shell 16 in its seat.

In the event that the retraction/protraction mechanism 14 fails and, if no glue was placed on threaded portion 26, the outer tip 22 can be unscrewed to release the mechanism and shell so that the old mechanism can be removed and replaced with a new one. Although this arrangement performs satisfactorily from an operational standpoint there is a desire to improve the aesthetics of the pen by extending the outer shell over essentially the entire length of the pen. This has been done, for example, as shown in FIG. 2 where shell 36 extends all the way to the distal end of the pen. However, this arrangement has several disadvantages. Shell 36 is generally too thin to provide any screw threads so that conventionally an extension 38 having an external threaded portion 40 is threaded into threaded portion 12 of retraction/protraction mechanism 14 and a generally frustoconical surface portion 42 having a shape generally matching that of shell 36 is attached to the shell by adhesive. Thus once the pen is assembled mechanism 14 is permanently locked into the pen so that if the mechanism fails the pen is not repairable. This is undesirable particularly since the mechanism is generally only a fraction of the cost of the gold or silver shell. The FIG. 2 structure has a further disadvantage in that the distal end portion 44 is unprotected and exposed to damage. Conventional gold or silver plating can more easily wear off at the end thereby exposing the base metal and adversely affecting the appearance of the pen.

Another limitation of conventional writing instruments relates to the clip which is generally mounted at the opposite end of the instrument. Typically, such clips have a flexible arm attached at one end to the shell, or cap if one is provided, with the opposite end biased against the respective shell or cap. The bias force tends to decrease with age thereby increasing the possibility of having the instrument dislodged from one's pocket resulting in losing the instrument.

SUMMARY OF THE INVENTION

It is an object of the present invention to provide a writing instrument which overcomes the above noted prior art limitations. Another object is the provision of a writing instrument housing having improved structural support for the distal or writing end of the outer shell of the housing which can be easily disassembled for purposes of repair. Yet another object is the provision of a writing instrument housing of enhanced aesthetic quality. Another object is the provision of a writing instrument having an improved clip for attachment of the instrument to a pocket or the like.

Briefly, in accordance with a first embodiment of the invention, a special generally cylindrical tip member having a shell receiving seat formed contiguous to an outer distal end of the member and having an external thread portion at an opposite end to receive an intermediate bushing element having an internal thread at one end receivable on the threaded element of the tip member. An external thread is formed at an opposite end of the intermediate bushing element for reception in the internal threads of the ball point pen retraction/protraction mechanism. According to a feature of the invention the outer housing portion of the writing instrument, i.e., the so-called barrel or shell, having a continuous outer layer of selected material such as silver or gold, is seated on the special tip member closely adjacent to the distal end of the writing instrument which provides suitable protection to the end portion of the shell while at the same time providing a shell which extends essentially to the end of the instrument. The shell is removably locked in the seat by means of the intermediate bushing element whose outer surface is wedged against the decreasing tapered surface of the shell. According to yet another feature of the invention, an inner shell may also be provided formed of selected material so that various ornamental designs can be provided which include piercing through the outer shell at selected locations to thereby provide a selected pattern having a desired aesthetic effect. By way of example, a gold surface can be provided on the outer shell and an enameled or silver surface on the outer surface of the inner shell.

According to a modified embodiment the outer shell is swaged providing a thicker small diameter end portion to enable forming an internal thread in the bore of the barrel adjacent the distal end. An elongated bushing member has a first end threaded for engagement with the thread in the bore of the shell so that its distal end is essentially flush with the distal end of the shell. The elongated bushing member is formed with an external thread at its opposite end for reception in the retraction/protraction mechanism of the writing instrument. As in the first embodiment an inner shell can be placed within the outer shell and conveniently removably locked in place by means of the retraction/protraction mechanism threaded into the elongated bushing member and wedging the inner shell against the outer shell.

According to another embodiment of the invention a spring clip for securely placing a writing instrument or the like in a pocket or other container comprises a rigid arm extending longitudinally along the outer surface of the instrument with one end biased into engagement with the outer surface. The opposite end of the arm is formed with a laterally extending distal end received through an opening in the outer shell of the instrument adjacent an end thereof. A spring receiving seat is formed in the instrument at the end and a suitable spring is disposed in the spring seat and provides a bias against the laterally extending distal end of the rigid arm.

Additional objects and features of the invention will be set forth in part in the description which follows and in part will be obvious from the description. The objects and advantages of the invention may be realized and attained by means of the instrumentalities, combinations and methods particularly pointed out in the appended claims.

BRIEF DESCRIPTION OF THE DRAWINGS

The accompanying drawings, which are incorporated in and constitute a part of the specification, illustrate preferred embodiments of the invention and, together with the description, serve to explain the objects, advantages and principles of the invention. In the drawings.

DETAILED DESCRIPTION OF PREFERRED EMBODIMENTS

Figure 1:
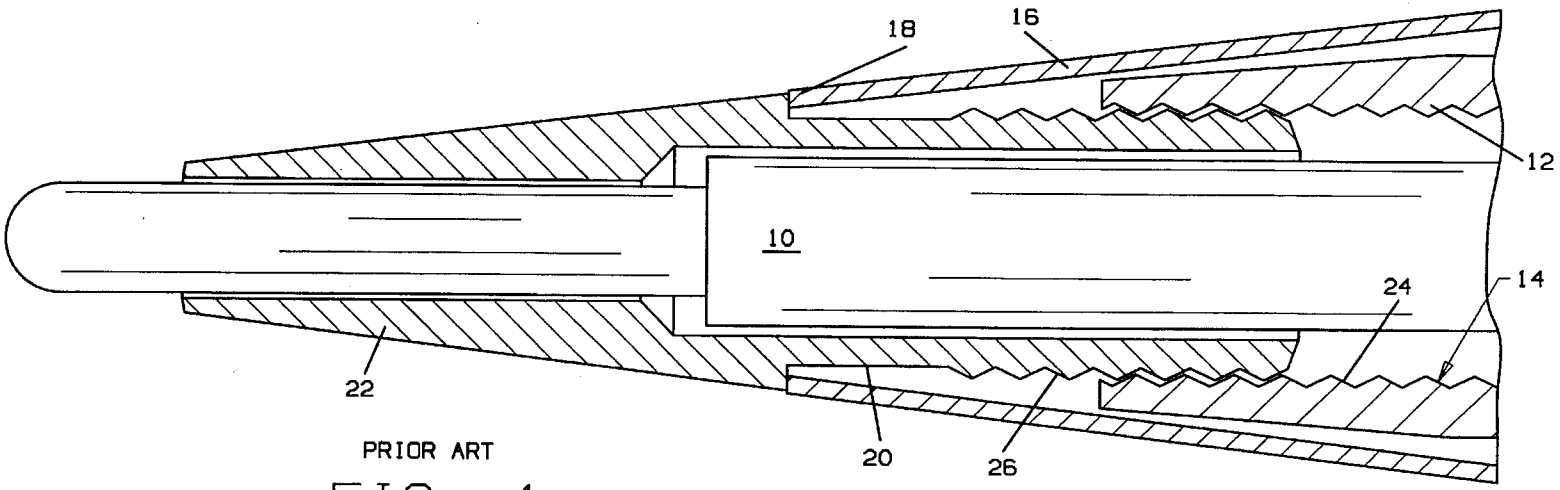
PRIOR ART FIG. 1
FIG. 1 is a cross-sectional plan view of the writing end of a conventional ball point pen.
Figure 2:
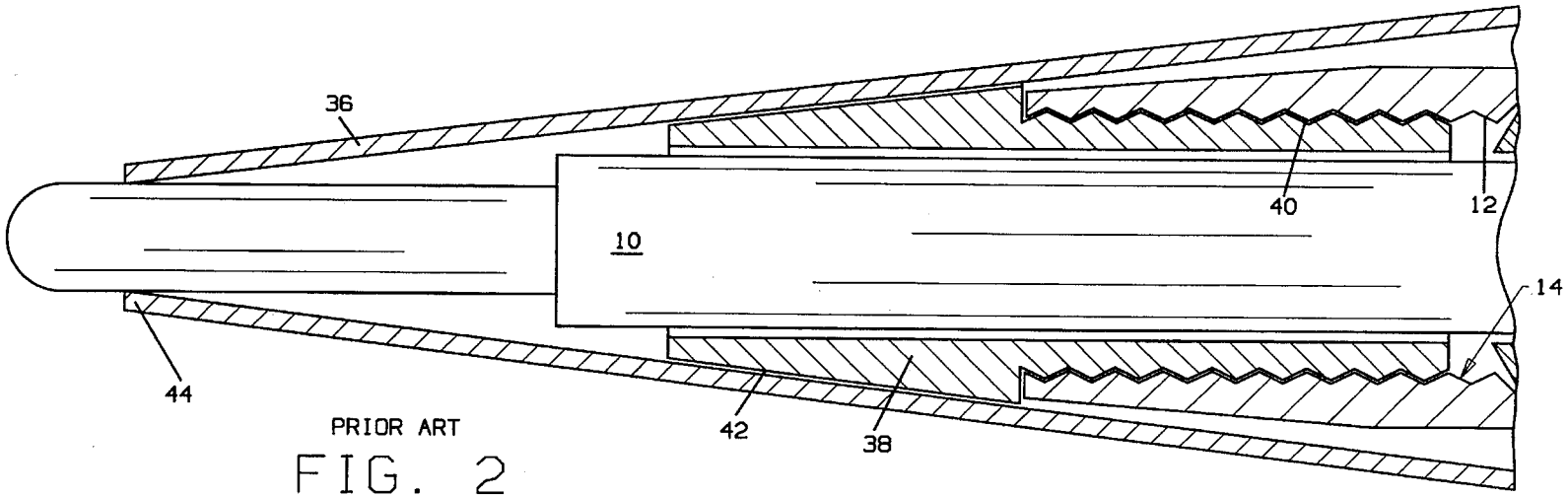
PRIOR ART FIG. 2
FIG. 2 is a cross-sectional view similar to FIG. 1 of another conventional writing instrument.
Figure 3:
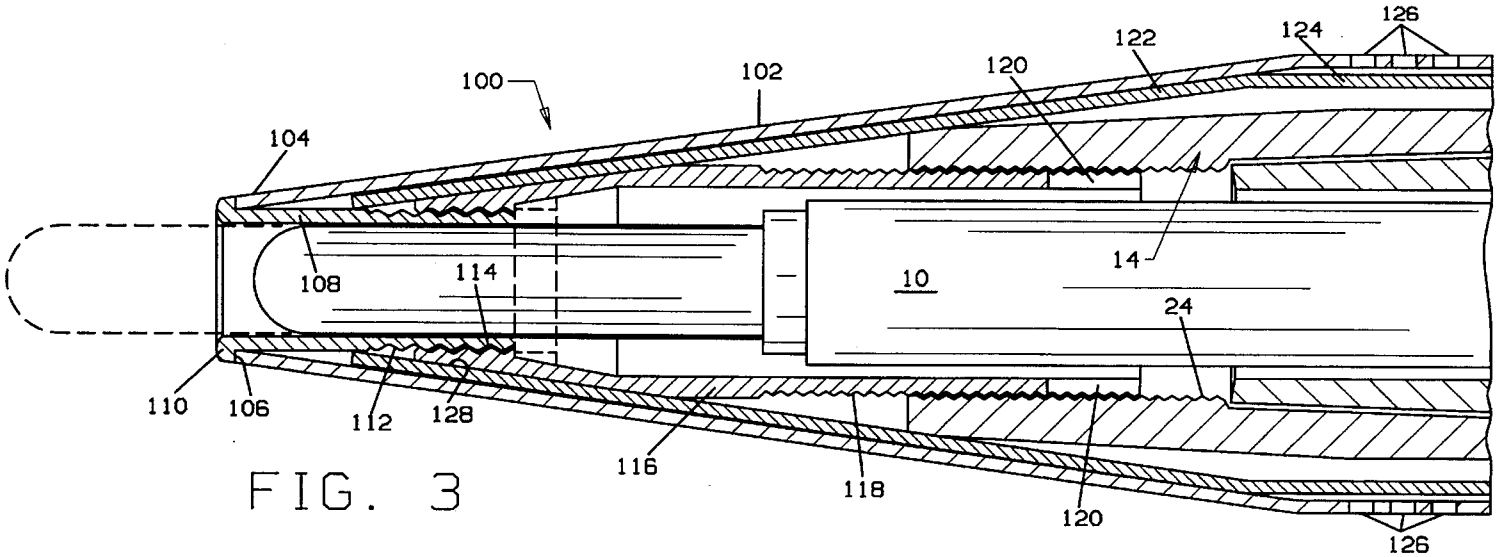
FIG. 3 is a view similar to FIGS. 1 and 2 of an improved writing instrument made in accordance with the invention.

With reference to FIG. 3, a writing instrument 100, made in accordance with a first embodiment of the invention comprises a conventional ball point and ink chamber 10 movable between a retracted position shown in solid lines and a protracted or writing position shown in dashed lines by a conventional retraction/protraction mechanism 14. Outer shell 102, formed of a selected material, typically a precious metal such as a solid or plated gold or silver metal has a first tapered end 104 received on a seat 106 formed at one end of a special tip member 108 formed of suitable material, such as stainless steel, which will provide adequate protection for the writing tip end of the instrument. Tip member 108 is generally cylindrical having a radially extending flange contiguous to an outer end 110 forming seat 106 which forms a smooth continuous surface with outer shell 102. An external thread 112 is formed at the opposite end of tip member 108 which receives the internal thread 114 of an intermediate bushing element 116 at one end thereof. The opposite end of intermediate bushing element 116 is provided with an external thread 118 for threaded engagement with internal threads 24 of retraction/protraction mechanism 14. Preferably, longitudinally extending aligned slots 120 are provided at the end of intermediate bushing element 116 having the external threads to facilitate attachment and removal of tip member 108. According to a feature of the invention, a separate, inner shell 122 formed of suitable material such as solid or plated silver, gold or enamelled metal, may be mounted within outer shell 102, preferably with the cylindrical portion 124 spaced slightly from the outer shell. A selected pattern of apertures are pierced through outer shell 102 so that the surface of inner shell 122 can be seen through the apertures. Thus a pleasing, unusual and aesthetic effect can be provided by use of appropriate colors, surfaces and the like. Spacing the inner shell from the outer shell enhances the visual effect by emphasizing the three dimensional effect.

Intermediate bushing 116 is provided with a generally frustoconical outer surface area 128 to wedge against the inner, or outer shell if only a single shell is employed, to lock the shells in place.

Figure 4:
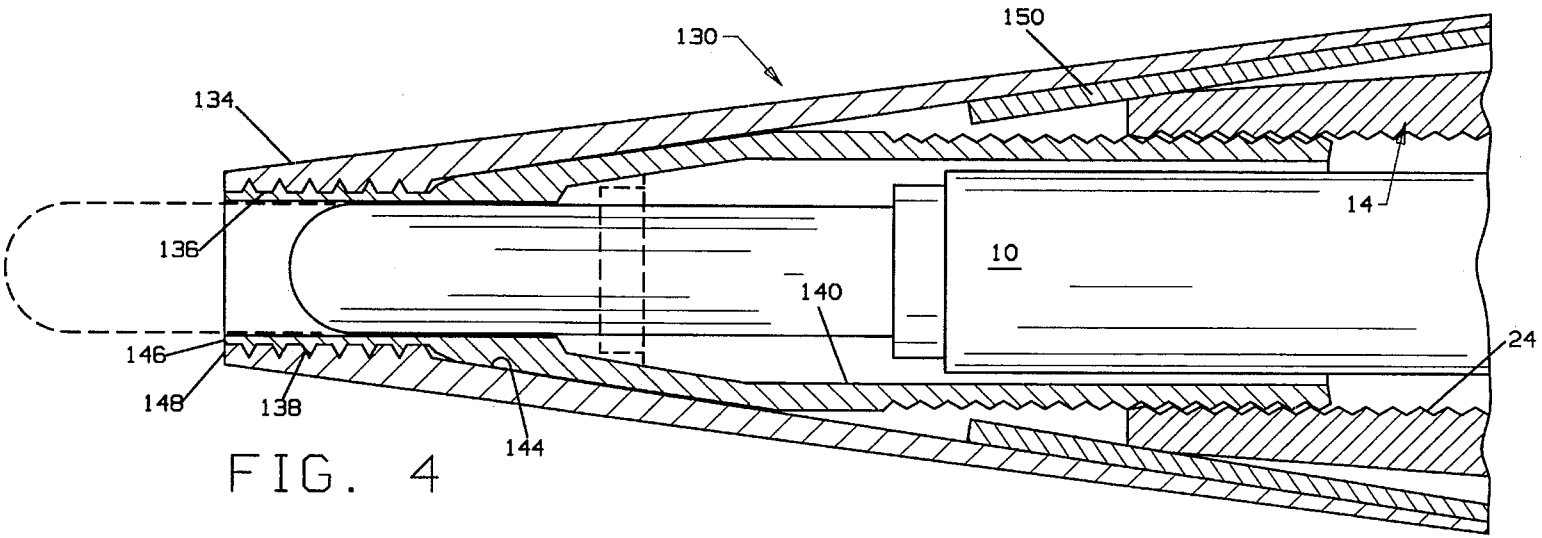
FIG. 4 is a view similar to FIG. 3 of a modified embodiment of the invention.

With respect to FIG. 4, a modified embodiment comprises a writing instrument 130 having an outer shell 132 of selected material such as a solid or plated gold or silver metal which is formed by swaging so that the tip end 134 has a thickened wall portion. An internal thread 136 is formed in the thickened wall portion adapted to threadingly receive an external thread 138 of one end of a bushing member 140 formed of suitable material such as stainless steel. Bushing member 140 has an external thread 142 formed at its opposite end for reception in retraction/protraction mechanism 14. The outer peripheral surface 144 of bushing member 140 is generally frusto-conical in configuration and engages the inner surface of outer shell 132 as the bushing member is screwed into the threaded bore of the outer shell with the outer end surface 146 being essentially flush with the outer end surface 148 of the outer shell. As a result, the writing tip end of the outer shell is protected by the bushing member. As in the FIG. 3 embodiment, an inner shell 150 can be used to provide desired visual effects. As shown in FIG. 4, retraction/protraction mechanism 14 can be wedged against the tapered end of the inner shell to lock it in place.

Figure 5:
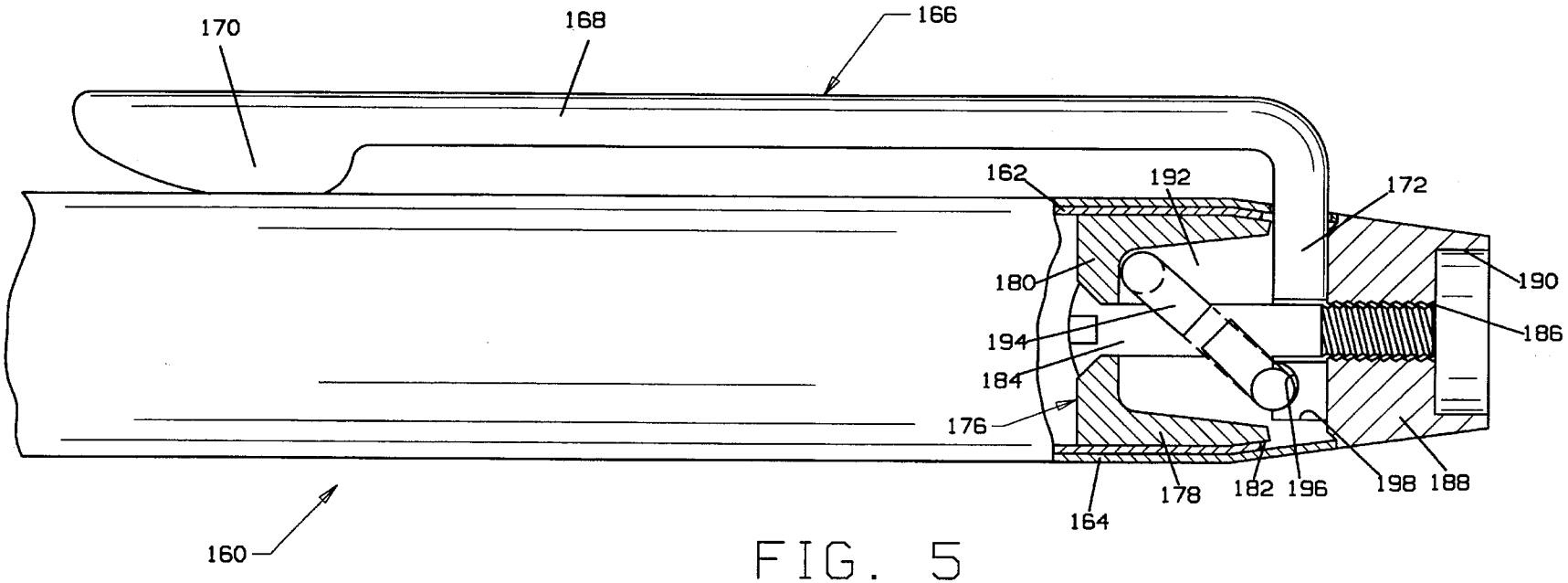
FIG. 5 is a view of the clip end of a writing instrument, partly in cross-section, made in accordance with another embodiment of the invention.

With reference to FIG. 5, a writing instrument 160 made in accordance with the invention comprises inner and outer shells 162, 164 respectively although a single shell could be employed if desired. A rigid clip member 166 has an arm portion 168 extending longitudinally along the length of the writing instrument with an end 170 biased toward the writing instrument. The opposite end of clip member 166 has a laterally extending end 172 which extends through an opening in shell 164. A bore 174 is provided in laterally extending end 172. A cup shaped bushing 176 having a cylindrical side wall 178 and end wall 180 is received in the open end of shells 162, 164. The outer distal end portion of side wall 178 is inwardly tapered at 182 which matches a corresponding taper in shells 162, 164 which serves to limit outward maovement of bushing 176. A screw 184 is received through a bore in end wall 180 and extends through bore 174 in end 172 and is received in threaded bore 186 of end cap 188. A recess 190 is formed in the end surface of end cap 188 for reception of a decorative disc shaped member, e.g., onyx. The recess 192 formed in cup-shaped bushing 176 serves as a seat for a spring element 194 which extends from bottom wall 180 to a cut out portion 196 formed in lateral end 172 immediately adjacent its free distal end 198. Spring member 194 can be a circular spring with screw 184 received centrally therethrough. Spring member 194 applies a biasing force to the lateral end 172 to provide the desired bias of arm 168 against the writing instrument.

A writing instrument made in accordance with the invention, as described above, not only has the enhanced aesthetic qualities of a shell extending essentially to the writing tip of the instrument but it also can be disassembled for repair. Further, the pierced outer shell with coordinated inner shell surface provides pleasing visual effects. The improved clip arrangement provides a longer lasting means of attachment.

Although the invention has been described with regard to specific preferred embodiments thereof, variations and modifications will become apparent to those skilled in the art. It is therefore the intention that the appended claims be interpreted as broadly as possible in view of the prior art to include all such variations and modifications.

What is claimed:

1. A writing instrument housing comprising an elongated, cylindrical outer shell having a tapered open end, a retraction/protraction mechanism received within the outer shell, the mechanism having an end facing the tapered end formed with an internal thread, a tip member fitting within the open end of the outer shell, the tip member being generally cylindrical having a longitudinally extending bore extending between first outer and second inner ends and having the first outer end formed with a radially extending cylindrical flange forming a recessed cylindrical seat contiguous with the distal portion of the first outer end, the tapered end of the outer shell received on the seat so that the tapered end is essentially flush with the outer perimeter of the radially extending cylindrical flange at the first outer end of the tip member and with the entire tip member, except for the flange, received within the outer shell, the tip member having an external thread at the second inner end of the tip member, and a cylindrical intermediate bushing element having an internal thread at one end of the bushing element for threaded engagement with the external thread of the tip member and an external thread on an opposite end of the intermediate element for threaded engagement with the internal thread of the mechanism so that the tip member is locked into place with the outer shell received in the cylindrical seat.

2. A writing instrument housing according to claim 1 in which the tip member is formed of stainless steel and the outer shell has an outer surface of precious metal.

3. A writing instrument housing according to claim 1 in which the outer shell has a selected pattern of apertures formed therethrough and further including a second, inner shell having an outer surface portion aligned with and spaced from the pattern of apertures to provide a selected three dimensional visual effect.

4. A writing instrument housing according to claim 3 in which the outer surface of the inner shell has different surface characteristics from that of the outer surface of the outer shell.

5. A writing instrument housing according to claim 1 in which the opposite end of the cylindrical intermediate bushing element is formed with a pair of aligned slots extending to the edge of the opposite end to facilitate assembly and disassembly of the writing instrument.

6. A writing instrument housing according to claim 1 in which a ball point refill is received in the retracting/protracting mechanism.

* * * * *